US007784391B2

(12) United States Patent
Vallebrant et al.

(10) Patent No.: US 7,784,391 B2
(45) Date of Patent: Aug. 31, 2010

(54) ARRANGEMENT FOR CONTROLLING A HYDRAULICALLY DRIVEN MOTOR

(75) Inventors: Per-Ola Vallebrant, Trollhättan (SE); Mikael Sannelius, Älvsjö (SE)

(73) Assignee: Parker-Hannifin Corporation, Cleveland, OH (US)

( * ) Notice: Subject to any disclaimer, the term of this patent is extended or adjusted under 35 U.S.C. 154(b) by 1002 days.

(21) Appl. No.: 10/549,728

(22) PCT Filed: Mar. 19, 2004

(86) PCT No.: PCT/SE2004/000409

§ 371 (c)(1),
(2), (4) Date: Oct. 2, 2006

(87) PCT Pub. No.: WO2004/083648

PCT Pub. Date: Sep. 30, 2004

(65) Prior Publication Data

US 2007/0034077 A1 Feb. 15, 2007

(30) Foreign Application Priority Data

Mar. 21, 2003 (SE) ..... 0300761

(51) Int. Cl.
*F15B 13/04* (2006.01)

(52) U.S. Cl. ..... 91/418; 91/445; 91/446

(58) Field of Classification Search ..... 91/418, 91/429, 445, 446, 468, 469
See application file for complete search history.

(56) References Cited

U.S. PATENT DOCUMENTS 2,392,980 A * 1/1946 Fawkes ..... 91/473
2,565,208 A * 8/1951 Dietiker ..... 92/12.2
2,795,933 A 6/1957 McCallum
2,878,015 A * 3/1959 Panissidi ..... 60/368
2,884,902 A 5/1959 Headings
3,543,646 A 12/1970 Iijima
4,051,764 A 10/1977 Murata
4,364,827 A 12/1982 Guttman
4,722,258 A 2/1988 Johnson
5,293,914 A 3/1994 Hudson
6,026,730 A 2/2000 Yoshida et al.
6,041,683 A 3/2000 Timperi et al.
6,220,027 B1 4/2001 Heusser
6,244,158 B1 6/2001 Roche
6,986,368 B2 1/2006 Brown
7,017,460 B2 3/2006 Virvalo et al.
7,451,790 B2 11/2008 Villebrant et al.
7,487,706 B2 2/2009 Villebrant et al.

* cited by examiner

*Primary Examiner*—Igor Kershteyn
(74) *Attorney, Agent, or Firm*—Daniel J. Whitman

(57) ABSTRACT

The present invention relates to an arrangement for controlling a hydraulically driven motor, forming part of a hydraulic system in which hydraulic fluid under pressure forms a main flow through a main duct in which the motor is connected. The motor drives a varying load, and one or more valves (7) are adapted for controlling the hydraulic fluid flow through the motor on the one hand during operation and on the other hand for starting and stopping of the motor. One of the valves consists of a flow control valve (7) which is connected in the main duct (1) downstream of the outlet of the motor, and the flow control valve (7) is integrated with the motor housing (50).

5 Claims, 3 Drawing Sheets

ARRANGEMENT FOR CONTROLLING A HYDRAULICALLY DRIVEN MOTOR

TECHNICAL FIELD

The present invention relates to an arrangement for controlling a hydraulically driven motor.

BACKGROUND OF THE INVENTION

In certain applications, hydraulic motors work under load which varies greatly over time, which has hitherto involved problems by virtue of the fact that the inertia in a conventional hydraulic system can mean that the hydraulic liquid flow is not sufficient for supplying the motor. Another critical situation with a risk of cavitation damage is when the motor is actuated into stop position.

BRIEF SUMMARY OF THE INVENTION

The object of the present invention is to eliminate the problems indicated in the introduction so that the motor can be controlled so as to perform its tasks with maximum effectiveness.

Said object is achieved by means of an arrangement according to the present invention.

DESCRIPTION OF FIGURES

The invention will be explained in greater detail below by means of an illustrative embodiment with reference to accompanying drawings, in which

FIGS. 2-4 show an advantageous example of a flow control valve which can be integrated in a motor block for flow control according to the invention, while

DETAILED DESCRIPTION OF THE INVENTION

Figure 1:
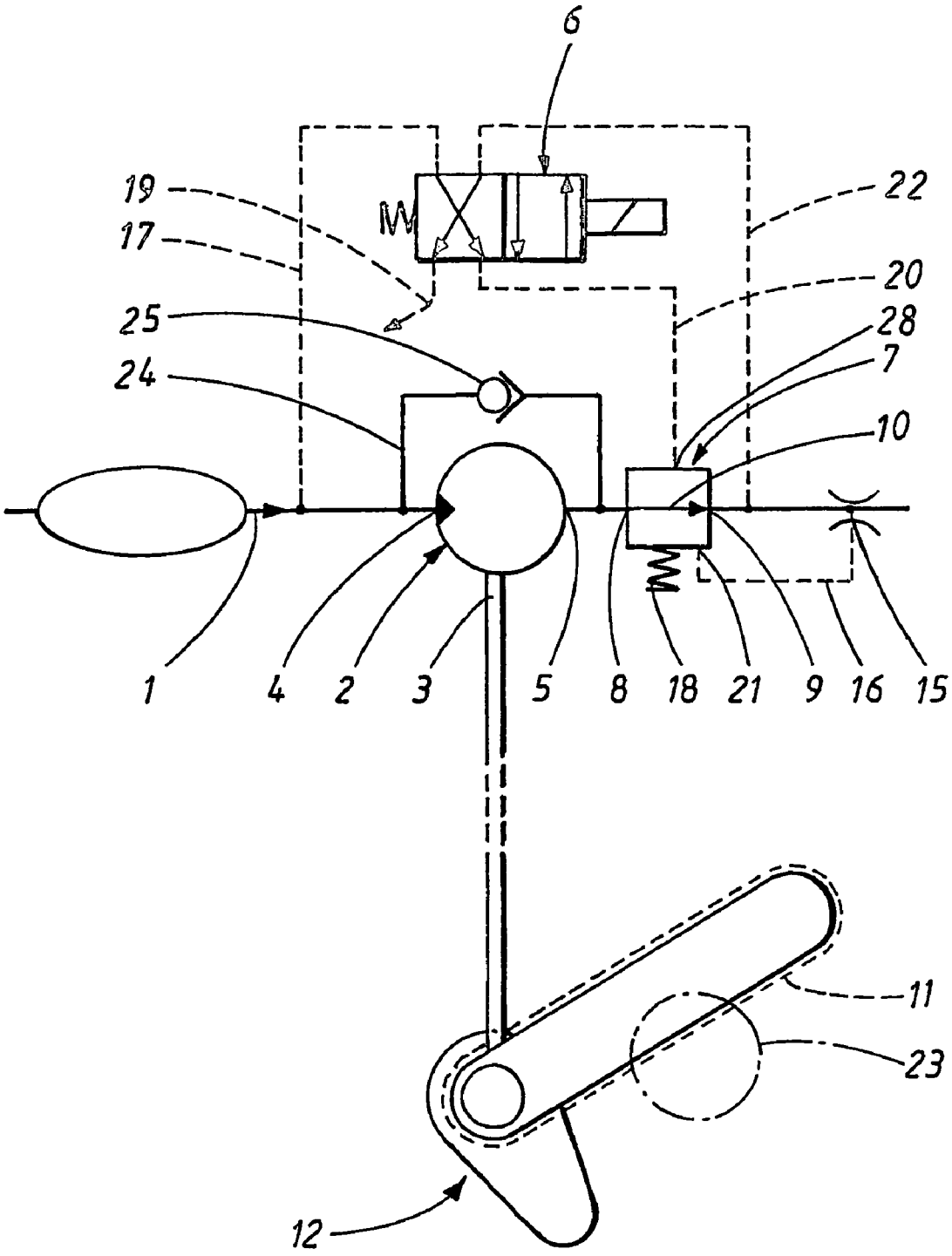
FIG. 1 shows a hydraulic system which includes an arrangement according to the invention.

A hydraulic system in which the arrangement according to the invention can be applied is accordingly shown in the example according to FIG. 1. The system includes a hydraulic fluid duct 1 for a main flow from a hydraulic fluid pump (not shown). Also present is a hydraulic fluid volume v, in which a hydraulic fluid pressure is maintained. Hydraulic fluid under pressure is the driving medium adapted to drive a hydraulic motor 2, included in the system, with an output rotation shaft 3, which is adapted to drive some form of unit which is to perform a certain task, for example a saw 11, such as a chain saw, in a harvester unit 12 for lumbering, to be precise sawing lumber. In this connection, the sawing unit and the hydraulic motor with its output rotation shaft are subjected to great instantaneous variations in load, entailing a risk of great instantaneous speed variations. The hydraulic motor has an inlet side 4, on which the hydraulic fluid is supplied under pressure, and an outlet side 5, from which the hydraulic fluid flows onward in the main duct 1 after pressure drop in the motor. The hydraulic system also includes a flow control valve 7, which is suitably of two-way type, with an inlet 8 and an outlet 9 and a throughflow 10 in a movable valve body, which can be adjusted between open and closed position under the action of an electrohydraulic actuator valve 6, which is adjustable between off position and on position, that is to say stop position and start/operating position, by means of an actuating device (not shown), which is actuated by an operator/computer.

The flow control valve 7 is connected downstream of the hydraulic motor 2 on its outlet side 5 and, in the example shown, has, in addition to the start/stop function, a constant flow function which is adapted so as, when the actuator valve 6 is in operating position and hydraulic flow passes through the flow control valve, to maintain an essentially constant hydraulic flow through the hydraulic motor 2, in principle irrespective of load variations of the motor. The throughflow of the flow control valve 7 is adapted to vary its throughflow area depending on the prevailing flow. In the example, this is achieved by sensing pressure drop across a following change in area, for example a narrowing 15, in the main duct 1 via a control duct 16 and via a control duct 22, which is connected to the main line 1 upstream of the narrowing 15, in which way the flow through the motor is controlled by means of the flow control valve depending on the pressure difference across the narrowing. The pressure-sensing upstream of the narrowing is led via the actuator valve 6. However, the narrowing can alternatively be positioned in locations in the system other than downstream of the constant flow valve, as is shown in the figure, for example upstream of the motor 2 or between the motor and the valve. Connected around the motor 2 is a shunt line 24, which includes a non-return valve 25, which is adapted for relieving pressure by being capable of opening in the event of pressure surges on the outlet side of the motor.

Figure 2:
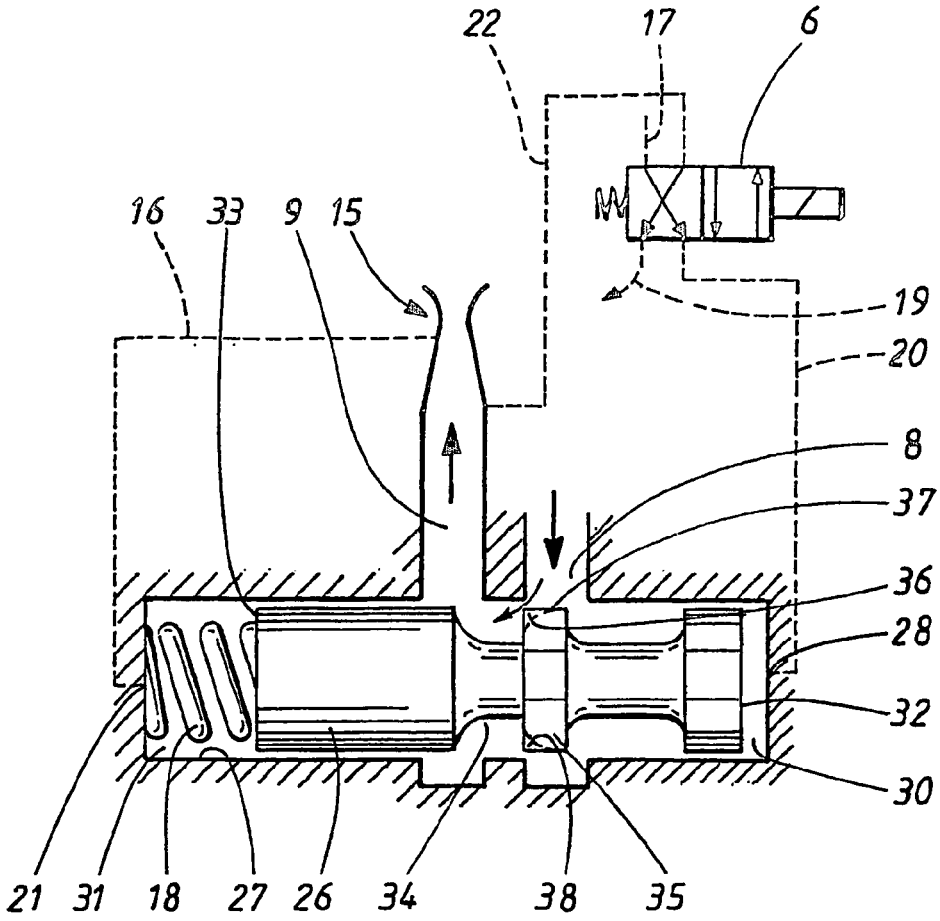
Figure 3:
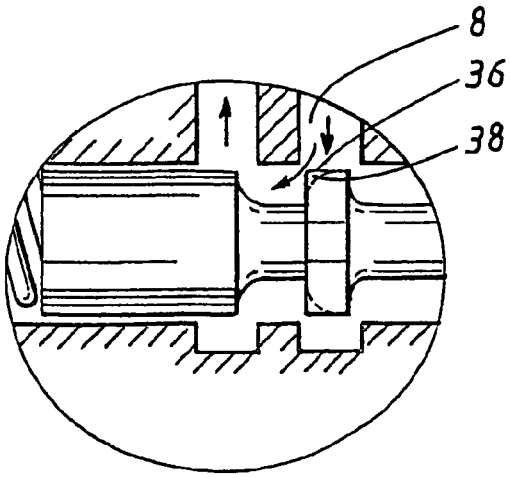
Figure 4:
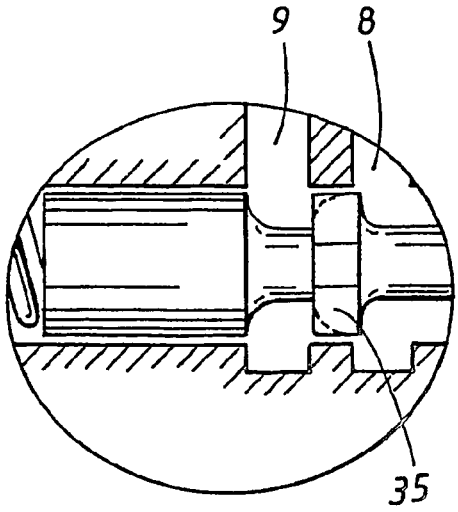

An example of an embodiment of the flow control valve 7 is shown in FIGS. 2-4. In this example, the valve body in the flow control valve 7 is embodied as a slide 26 in the form of a piston, which is movable linearly to and fro in a cylindrical bore 27 under the action of on the one hand two counteracting control pressures via the control ducts 16, 20, 22, which lead from the two sides of the narrowing 15 to their respective control input 21, 28 and on the other hand the force from the spring 18. The actuator valve 6 is connected in the same way as described with reference to FIG. 1, that is to say connected in one control duct 20, 22 between the narrowing 15, upstream thereof, and the control input 28. The control pressures act in their respective cylinder chamber part 30, 31 on the two sides of the piston/the slide 26 and create a pressing force against the respective piston surface 32, 33. The spring 18, which is suitably adjustable with regard to its spring preloading, provides the necessary additional force in order to determine at which pressure drop across the narrowing 15, and thus which speed of the motor, the slide begins to move. Arranged in the valve housing are a number of ducts for the hydraulic flows to be regulated by means of the valve. The main flow, that is to say the flow which drives the motor 2 and is to be regulated by the flow control valve 7, enters via the inlet 8 and flows out via the outlet 9. Flow regulation is effected by virtue of the throughflow 10 of the slide being formed by a passage in the form of an annular groove 34 and a bar 35 with a throttling edge 36 in the lateral wall 37 of the slide 26. By means of the axial displacement of the grooves under the action of the control pressures and the spring 18, the flow area between the inlet 8 and the outlet 9 is regulated, in which way the main flow is regulated. As indicated by dashed lines, the throttling edge 36 can be designed with throttling grooves 38, the design of which influences the control characteristic.

The functioning of the hydraulic system will now be described with reference to FIGS. 1-4. The general operating requirement according to the example shown is that as constant an optimized speed as possible of the motor 2 and its output rotation shaft 3 is to be maintained during normal operation and that extreme, instantaneous changes in speed are to be counteracted to as great an extent as possible, in spite of instantaneous load fall-off. An example of such an application is therefore sawing through a log 23, where the risk of what is known as racing arises owing to accumulated energy in hoses etc. symbolized by v, when the log has been sawn through and the load falls off. This is achieved by the flow control valve 7 being dimensioned to work with a rapid response and by this valve being positioned downstream of the motor 2, that is to say on its outlet side 5. When the actuator valve 6 is in stop position, the flow control valve 7 is controlled so as to be closed by the action of system pressure, that is to say full fluid pressure via the control duct 17, and control pressure from the control duct 20 counter to the action of the force from the valve spring 18. In the stop position, the pump pressure acts via the control duct 20 and via one control input 28 of the control valve 7 on one side 32 of the slide, which results in the slide 26 moving into end position and shutting off the entire main flow (see FIG. 4). It can be seen from the figure that the bar 35 completely blocks communication between the inlet 8 and the outlet 9. Any load-sensing via a sensing duct 19 senses low pressure at the same time. If the pump pressure should fall, the force holding the flow control valve closed decreases. On the other hand, the force for rotating the motor decreases at the same time.

When the actuator valve 6 is adjusted from stop position to start position/acceleration position, the flow control valve 7 is opened and is kept open because the control area is now acted on by the pressure in the control duct 22, which, in the start position, is the same as in the control duct 16 (see FIG. 3). It can be seen that the slide 26, by virtue of the action of the spring (compression spring), is displaced to the right in the figure in such a way that the bar 35 with its throttling edge 36 leaves the inlet open.

During operation, the flow control valve 7 works as a constant flow valve, the aim being to keep the hydraulic fluid flow through the flow control valve, and thus through the motor 2, constant by virtue of the valve being fully open when the flow is too low, and seeking to throttle the flow, that is to say brake the motor, when the flow is too high. If load-sensing is present, system pressure is sensed, which provides maximum flow. On stopping, the motor is braked on the rear side by the actuator valve 6 being adjusted to stop position again, the flow control valve 7 then being adjusted to closed position.

In the case of both constant flow control and stopping, the hydraulic fluid pressure at the motor inlet 4 is guaranteed the whole time by the system described, in contrast to known solutions with a compensator and a stop valve before the motor, where there is a risk of the motor running faster than the flow is sufficient for and thus rotating like a cavitating pump. By virtue of the start/stop function and the constant flow function being integrated in one and the same valve component, a compact construction and short fluid ducts for the main flow, especially between the valve and the motor, are made possible.

Figure 5:
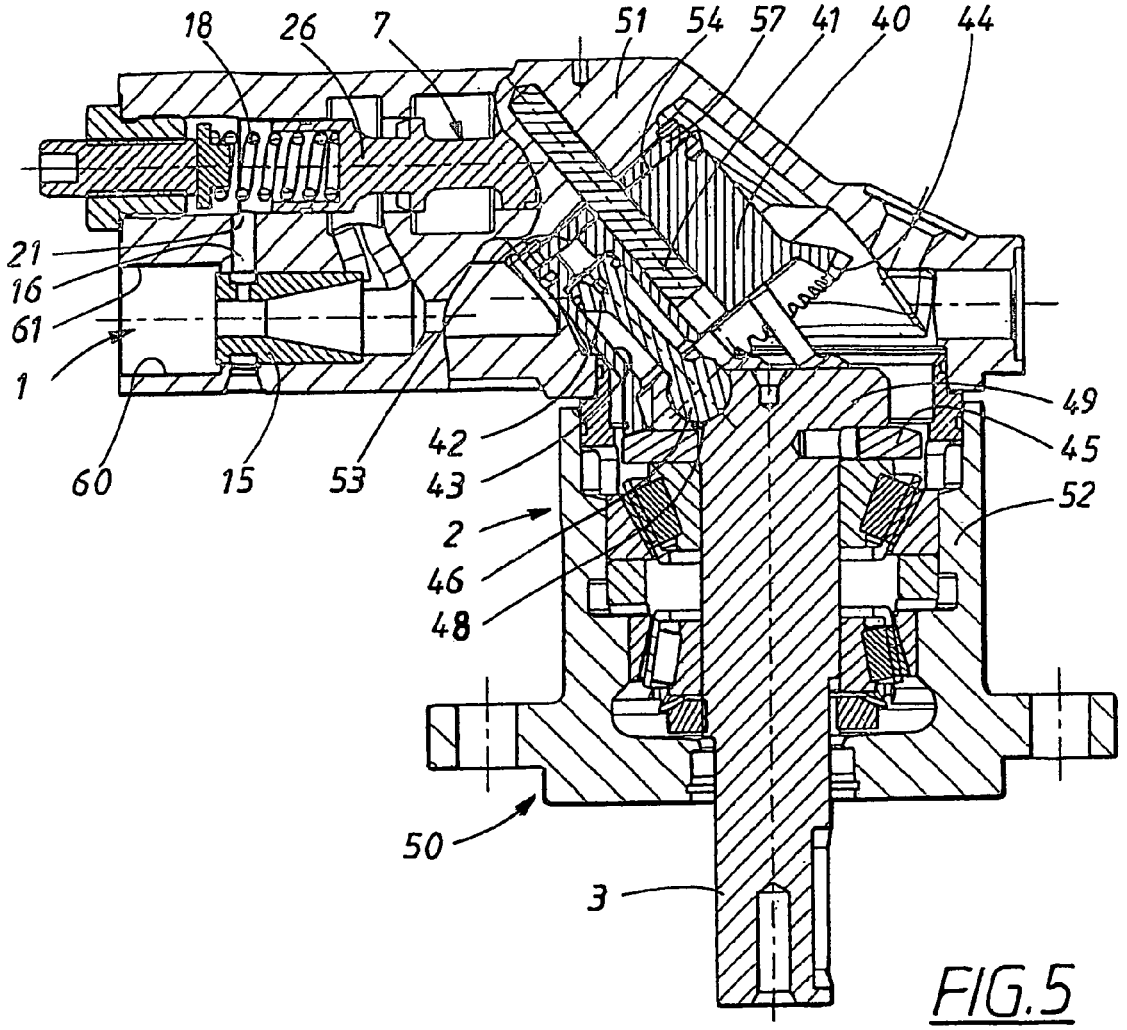
FIGS. 5 and 6 show partly sectional views of a hydraulic motor with an integrated flow control valve.
Figure 6:
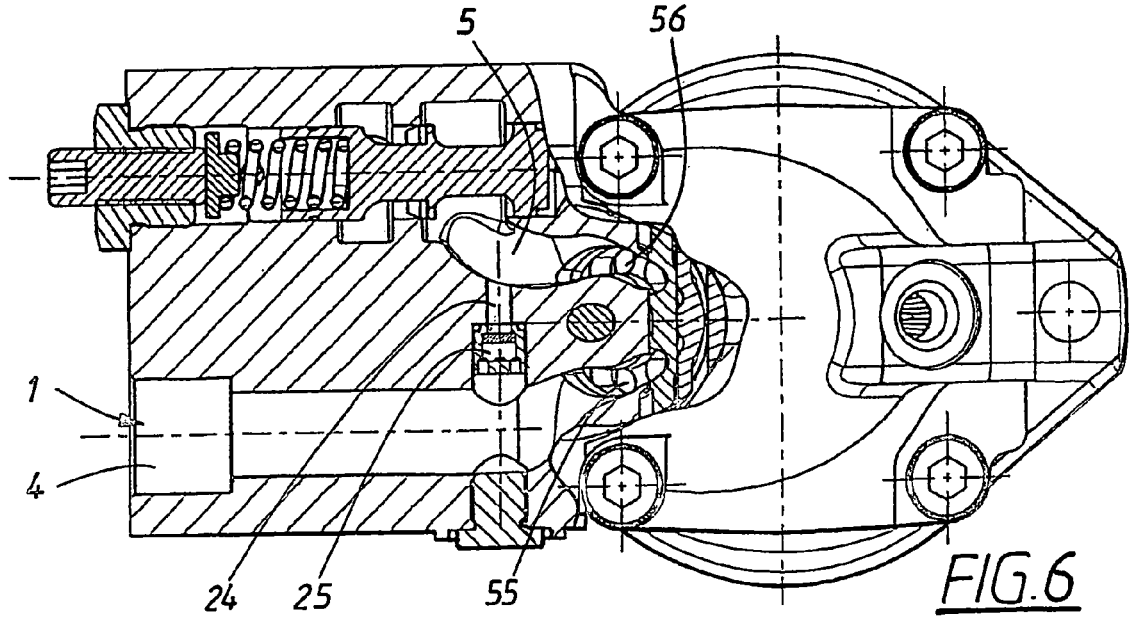

With reference to FIGS. 5 and 6, an example of a type of hydraulic motor 2 in which the invention can be applied will be described first of all. In the example shown, the motor is an axial piston motor. Briefly, the main parts of the motor are, in addition to the output rotation shaft 3 mentioned above and the inlet 4 to the motor and the outlet 5 from the motor, a cylinder drum 40 which has a rotation shaft 41 which is angled in relation to the longitudinal direction of the output shaft 3 because the motor is of the bent axis type. In the cylinder drum, a number of pistons 42, for example five, are movable to and fro in cylindrical bores 43. The motor shown has a synchronization system of the gearwheel synchronization type, for which reason the cylinder drum has a gear rim 44 which interacts with a gearwheel 45 which is mounted firmly on the output shaft 3. The pistons 42 transmit their motion via piston heads 46 in corresponding ball cups 48 in a rotary disk 49 on the output shaft 3, in which way the axial force is converted into a torque. Via fixed ducts in the motor housing or the motor block 50, which is divided into two parts 51, 52, the hydraulic flow between inlet and outlet is conveyed to openings 53 arranged in a ring-shape in the end surface 54 of the cylinder drum. For more detailed information about the basic construction and functioning of the hydraulic motor, reference is made to, for example, U.S. Pat. No. 6,336,391.

According to the invention, the flow control valve 7 is integrated in the motor block 50, in the example shown in the part 51 where motor inlet 4 and motor outlet 5 are arranged, that is to say as close as possible to the inner opening 56 of the motor outlet 5 and thus the end surface 54 of the cylinder drum 40. To be precise, the bore 27 of the valve slide 26 is a hole drilled in the motor block so that the cylindrical bore extends as close to the end surface 54 of the cylinder drum as possible, that is to say as close to the opening 56 as possible. In this way, the duct between the flow control valve and the inner opening 56 of the motor outlet 5 is as short as possible and moreover rigid because the motor block is made from a rigid material not prone to deformation, such as metal, for example steel, light metal or the like. With a selected cross-sectional area, this provides a minimized, "rigid" volume, in contrast to a case with a separate valve component outside the motor block, especially if the valve is connected to the motor via elastic hoses, which provides an elastic hydraulic fluid volume. The arrangement according to FIGS. 5 and 6 provides a rapid response with a reduced risk of racing of the motor and cavitation damage, in contrast to a case where the constant flow valve is positioned at the inlet instead of the outlet.

The valve 7 shown in different ways in FIGS. 2, 5 and 6 as an example is therefore of essentially one and the same construction, the two control inputs 21, 28 also being integrated in the motor block, although the control input 28 cannot be seen in FIGS. 5 and 6.

In the example shown in FIGS. 5 and 6, the narrowing 15 is also integrated in the motor block 50 and is in practice located in a borehole 60 with an opening 61 in the motor block for outflow of the main flow after the narrowing. This can also be integrated fully with the motor block in such a way that the wall surface of the motor block which forms the main duct 1 downstream of the flow control valve 7 is shaped as a narrowing.

In the example shown, the pressure relief circuit 24 with the non-return valve 25 is also integrated in a borehole in the motor block, which extends between the motor inlet 4 and the motor outlet 5.

The invention is not limited to the examples described above and shown in the drawing but can be varied within the scope of the patent claims below. For example, the valve can be of a type other than a combined on/off and constant flow valve. The valve can be other than a slide valve, for example one with a rotatable valve body. The motor can be of another type. The actuator valve 6 and the control ducts 17, 20, 22 can also be integrated in the motor block. Integration in the motor block 50 means that the component concerned is built into the motor block, which is designed with a "thickened" portion in order to accommodate the component. In this connection, it is conceivable for the motor block to be divided into a further part with a dividing line which, for example, extends between the flow valve 7 and the cylinder drum 40. Motor block 50 means the housing which encloses the parts of the motor.

The invention claimed is:

1. An arrangement for controlling a hydraulically driven motor, forming part of a hydraulic system in which hydraulic fluid under pressure forms a main flow through a main duct in which the motor is connected, the motor being adapted to drive a varying load, and one or more valves (6, 7) being adapted for controlling the hydraulic fluid flow through the motor on the one hand during operation and on the other hand for starting and stopping of the motor, one of the valves consisting of a flow control valve (7) which is connected in the main duct (1) downstream of the outlet of the motor, the flow control valve (7) being integrated with the motor housing (50), the flow control valve (7) is adapted for on the one hand starting/stopping of the motor and on the other hand constant flow control of the hydraulic fluid flow through the motor and is adapted to control the flow through the main duct depending on a sensed pressure difference across a change in area (15) which is arranged in the main duct downstream of the motor.

2. The arrangement as claimed in claim 1, characterized in that the change in area (15) is a narrowing that is integrated in the motor housing (50).

3. The arrangement as claimed in claim 1, characterized in that the flow control valve (7) has two control inputs (26, 28) for controlling the flow control valve, one control input (28) being adapted to receive a control flow which can alternately be connected to the main duct (1) upstream of the flow control valve for a stop position of the valve, that is to say blocking of the main flow, or connected to a control flow for a start position of the valve, that is to say fully open main flow, or constant flow control, and the other control input (21) being adapted to receive a control flow via a control duct (22) which is connected to a location in the main duct on one side of the change in area (15).

4. The arrangement as claimed in claim 3, characterized in that the flow control valve (7) has a valve housing and a valve body (50) which is movable in the valve housing and is provided with a throughflow passage (10) which is adapted so as, under the action of the force from the two control flows and a spring (18) and thus by virtue of the motion of the valve body, to vary its area relative to the inlet (8) or the outlet (9), and in that an actuator valve (6) is adapted for said changing between control flow to one control input (28) for start position with open flow control valve, constant flow control with variable main flow depending on the pressure drop across the change in area, and stop position with fully closed flow control valve.

5. The arrangement as claimed in claim 4, characterized in that the valve body consists of a piston slide (26) which is movable to and fro in a cylindrical bore (27), into one end of which one control input (28) leads and into the opposite end of which the other control input (21) leads.

* * * * *